United States Patent [19]

Treppesch

[11] 3,984,011

[45] Oct. 5, 1976

[54] CAR GARAGE WITH PIVOTAL VERTICALLY MOVABLE PARKING PLATFORMS

[76] Inventor: Franz Treppesch, Herbisrieder Strasse 2 a, 8944 Gronenbach, Germany

[22] Filed: Mar. 26, 1975

[21] Appl. No.: 562,116

[30] Foreign Application Priority Data

Mar. 30, 1974 Germany ..... 241552

[52] U.S. Cl. ..... 214/16.1 ED; 187/8.71

[51] Int. Cl.[2] ..... E04H 6/06

[58] Field of Search ..... 214/16.1 R, 16.1 ED, 214/16.1 EC; 187/8.71

[56] References Cited

UNITED STATES PATENTS

| | | | |
|---|---|---|---|
| 2,695,716 | 11/1954 | Graham | 214/16.1 ED |
| 2,815,872 | 12/1957 | Graham | 214/16.1 ED |
| 3,387,722 | 6/1968 | Fisher, Sr. et al. | 187/8.71 X |
| 3,741,412 | 6/1973 | Klaus | 214/16.1 ED |
| 3,786,940 | 1/1974 | Klaus | 214/16.1 ED |
| 3,861,540 | 1/1975 | Lendi | 214/16.1 ED |

FOREIGN PATENTS OR APPLICATIONS

| | | | |
|---|---|---|---|
| 1,124,411 | 7/1956 | France | 214/16.1 ED |

*Primary Examiner*—Robert J. Spar
*Assistant Examiner*—R. B. Johnson
*Attorney, Agent, or Firm*—Holman & Stern

[57] ABSTRACT

A garage having two vertically-spaced, superimposed parking platforms coupled for simultaneous tilting in parallel relation; the pair of platforms being raised from a lower position, in which both platforms are horizontal and the upper platform registers with a drive-in area or ramp, to an upper position, in which the platforms are tilted at an angle and the entrance end of the lower platform then registers with the drive-in area and the upper platform is positioned thereabove.

6 Claims, 2 Drawing Figures

CAR GARAGE WITH PIVOTAL VERTICALLY MOVABLE PARKING PLATFORMS

FIELD OF THE INVENTION

This invention is concerned with a garage for the storage and superimposed parking of vehicles.

BACKGROUND OF THE INVENTION

Garages of this kind for parking a number of vehicles are known. In one such case (German Patent No. 900,008) each platform has at the end remote from the drive-in area a fixed rocking linkage, whilst the ends adjacent the drive-in area are connected together by a linkage. When both platforms are lowered the user can drive on to the upper platform whilst the lower platform is made accessible by lifting both platforms.

The arrangement for tilting the two platforms in this known garage is accompanied by the disadvantage that the upper platform has a very severe inclination when it is in the drive-on condition, whilst the lower platform declines steeply when it is available to be driven on to. In both cases, the inclination is so great as to involve difficulties with some vehicles, namely that during upward travel either the front or the rear parts of the vehicle strike the ground or the platform, and in the case of a downward inclination, that is to say in the case of the drive-in position on the lower platform, there is the danger of collision between the parts of the vehicle between the axles and the beginning of the platform or the end of the drive-in. The danger of collision increases the shorter the platforms.

Other suggestions are known (German Specification No. 1,684,753) in which by special movement of the two platforms towards one another the inclination can be kept smaller, within certain limits, than in the case of the garage first described above. Even with this other garage however the upper platform has an upward inclination in its drive-on status, and the lower platform in this status a declivity, which is very substantial in both cases.

Garages of the kind described above are principally used where space is at a premium. Specifically garages of this type having two platforms are arranged in underground garages of tall buildings with the object of disposing of a double tally of vehicles for the same surface area. This however frequently involves the problem that, because of the restricted space available the downwardly inclined drive-in ends right on the parking places, that is to say that the drive-on to the platforms does not take place from a level vehicle standing area but from an area which actually has a downward inclination. Thus there are difficulties in driving on to the upper platforms of these known constructions, and in some instances they wholly become impossible.

The object of the present invention is to provide for such purposes a garage which not only complies with the access requirements of such garages, but caters for the minimum of space utilisation for the individual parking places. A further object is to provide an arrangement of this nature which allows for the use of simple individual constructional parts which are readily accessible for inspection and which can be fabricated at minimum expense.

The invention provides a garage of the kind set forth above which comprises means for raising and lowering the platforms in unison and tilting them in unison, and the arrangement whereby the lower platform is inclined downwardly away from the entrance when the drive-on end is in register with this entrance and the platforms are substantially horizontal when the upper platform is in register with said entrance.

Having regard to the fact that in this arrangement the upper platform has no significant upward inclination in its drive-on status, access can be had by the driver without any difficulty to a parking space with a maximum drop.

SUMMARY OF THE INVENTION

The primary object of the invention is to provide a garage for the storage and superimposed parking of vehicles which solves the problems recited above, and in which there is provided an enclosure with an entrance thereto, a drive-in area adjoining the entrance, a parking structure disposed in the enclosure and comprising two platforms in stacked arrangement and mounted for selective orientation to the entrance of the drive-in area, and means coupling the platforms to maintain them in parallel relation in all positions of movement.

On the other hand a very favourable situation is secured by the downward inclination of the lower platform in its drive-on status. A downward inclination to the parking areas can be continued on to the lower platform, perhaps without any change of angle at all.

The inclination of the two platforms in the drive-on condition of the lower platform has the further advantage of optimum utilisation of space. The fact that these two platforms have a downward inclination in this condition, the upper platform as well because it is kept parallel to the lower platform, not only makes for a favourable drive-in situation on to the lower platform but also minimises the space requirement in the raised condition of the upper platform. Since the rear end of the vehicle generally is of smaller height than that of the centre of the vehicle it is not necessary to provide the space for the raised upper platform which for example is available between the two platforms.

What is of further value in the present invention is that vehicles which, because of their shape do not give the above-mentioned saving of space, that is to say, for example, combination vehicles and other vehicles with a box body, can be parked on the lower parking area which is of a uniform height over its full length.

The two platforms may be coupled by simple links, as is known in the art, and these will preferably be disposed at the ends remote from the drive-on area. It is possible, however, to effect the connection by other members, for example by an appropriate combination of hydraulic driving elements which preserve a parallel disposition of the two platforms.

It is not outside, the possibilities of the present invention if, for example, the two platforms move at different times from the lowermost position to the upper position and when there is a lack of parallelism between them at a time during this movement. What is of practical importance in the present invention is that the platforms are parallel at the time a vehicle is actually being driven on to one of them. If they can be parallel at all stages in their movement then of course this can be achieved using simple coupling members only.

In a preferred embodiment of the invention, a column is arranged laterally of the platforms and a slide is vertically displaceable in this column and carries pivotable connections for the two platforms which preferably will be arranged directly on the slides. It is enough for one such column on one side only of the platforms to be used. It is better, however, to choose a completely symmetrical arrangement with columns at both sides of the platforms.

It should be noted at this point that the invention is of course usable in garages which will accommodate two or more vehicles side-by-side on each platform, because this does not increase the problems with which the invention copes. Advantageously, a draw member is provided between the platforms and the slide to limit the range of tilting movement of the platforms in one direction at least. It has been found that favourable conditions are achieved where the draw member determines the horizontal position of the platforms.

In accordance with a further proposal, use is made of a fixed abutment to cooperate with the platforms and determining the tilting movement of the platforms during the stroke of the slide. Such an abutment will best be arranged at the end of the platforms remote from the drive-in area and preferably will co-act with the lower platform.

When the slide is raised, the horizontal position is first retained until the abutment becomes effective and forces them into the inclined disposition with the lower platform available for drive-on purposes.

A power unit may be used to operate the slide. It is of advantage where, by an appropriate distribution of weight of the platforms, they are biassed into the horizontal position both loaded and unloaded.

An embodiment of the invention is diagrammatically illustrated in the accompanying drawings in which:

DESCRIPTION OF A PREFERRED EMBODIMENT

Figure 1:
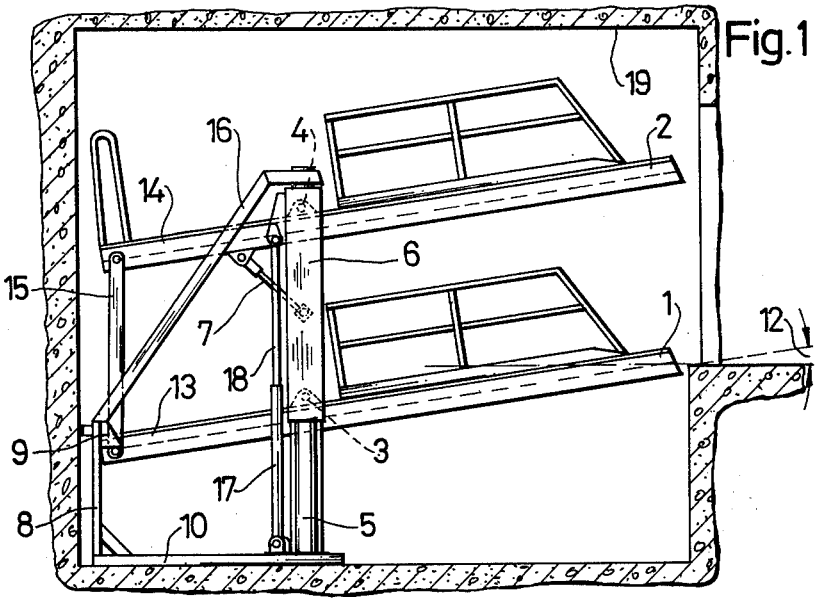
FIG. 1 is a diagrammatic side elevational view of a garage enclosure constructed in accordance with the present invention with the lower platform in a drive-in position.

The two platforms 1 and 2 illustrated in the drawings are pivoted at 3 and 4 respectively on a slide 6 which is displaceable on a column 5 attached to a foundation frame 10. They are connected by a link 15 at their ends 13 and 14 to maintain them parallel. A piston 18 of a piston-cylinder assembly 17, 18 engages the slide 6.

Figure 2:
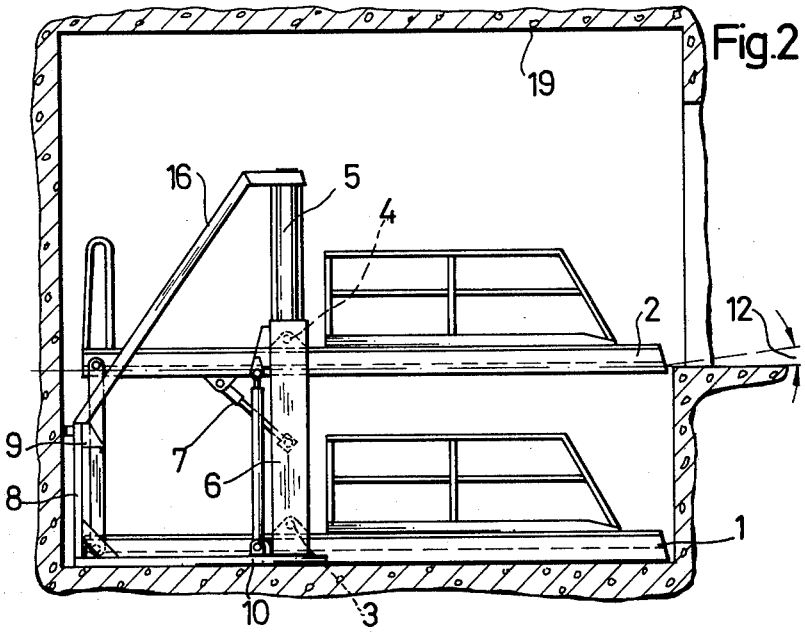
FIG. 2 shows the arrangement of FIG. 1 with the upper platform moved to the drive-in status position.

A draw member 7, which for example may be a pin and elongated slot construction or be a simple section of a wire rope, is connected between the upper platform 2 and slide 6. FIG. 2 shows this draw member in its maximum extended condition.

In addition to the column 5, the foundation frame 10 carries a strut 8 for an abutment 9 cooperating with the inner end of the lower platform 1. The upper ends of the strut 8 and the column 5 are connected by a tie member 16 to increase the rigidity of the construction. The reference numeral 12 designates the drive-in area.

OPERATION

As can be seen particularly from FIG. 1, it is apparent that the driver can drive onto the lower platform 1 without difficulty even when the drive-in area is slightly inclined. Moreover, the upper platform (see FIG. 2) is readily accessible even when there is a maximum incline of the drive-in area. In the raised condition of the structure, the spacing of the upper side of a vehicle (not shown) on the upper platform 2 from the roof 19 will be relatively small, which is an advantage as regards maximum utilization of the available space.

I claim:

1. In a garage for the storage of vehicles comprising an enclosure with an entrance thereto, a drive-in area adjoining said entrance, a parking structure disposed in said enclosure and comprising two vertically spaced, horizontally-disposed, elongated platforms, means mounting the platforms for selective presentation of one end thereof to said entrance and said drive-in area, means for raising and lowering the platforms in unison and tilting them in unison about a respective vertically spaced horizontal pivot axis located intermediate the ends of a respective platform, means pivotally coupling said platforms together to maintain them in parallel relation during all positions thereof, when the one end thereof is in register with said entrance and drive-in area, said platforms being substantially horizontal when the upper one of said platforms is in register with said entrance, said enclosure having a base, at least one vertically-extending, platform-supporting column mounted on said base and upon which the two vertically spaced platform are supported, a slide member slidably supported on said column, vertically spaced pivot means pivotally mounting each respective platform on said slide member and defining said respective horizontal pivot axis of the platforms, and stationary abutment means positioned in the vertical path of movement of one end portion of said lowermost platform for engagement thereby so that when the platforms are raised a predetermined vertical distance they are tilted upwardly.

2. A garage according to claim 1, in which the weight distribution of the platforms is such that they are biassed into a horizontal position both when loaded and unloaded.

3. A structure as claimed in claim 1 in which said means coupling the platforms to maintain them in parallel relation comprises a linkage pivotally connected to inner ends of the respective platforms on horizontal pivot axes remote from the entrance of said enclosure, and defining with said slide member and platforms a parallel linkage for maintaining the platforms in parallel relation as they are raised and lowered.

4. A structure as claimed in claim 1 including a draw member connected between the slide member and at least one of said platforms for limiting the maximum pivoted relationship of said platforms relative to said slide member.

5. The structure as claimed in claim 1 in which said means for raising and lowering the platforms in unison includes a piston-cylinder assembly connected between the enclosure and said slide member for raising and lowering the slide member on the column.

6. The structure as claimed in claim 1 in which said abutment means includes strut means extending vertically from the base, a rigid tie member, the strut means being connected to the vertical column by the rigid tie member.

* * * * *